US010122080B2

(12) United States Patent
Lai et al.

(10) Patent No.: US 10,122,080 B2
(45) Date of Patent: Nov. 6, 2018

(54) SUPPLY CABLE, A DRIVER ARRANGEMENT WITH WIRELESS CONTROL FUNCTION AND A CONTROL METHOD

(71) Applicant: PHILIPS LIGHTING HOLDING B.V., Eindhoven (NL)

(72) Inventors: Bing Lai, Eindhoven (NL); Yunfeng Li, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 33 days.

(21) Appl. No.: 15/518,659

(22) PCT Filed: Sep. 30, 2015

(86) PCT No.: PCT/EP2015/072498
§ 371 (c)(1),
(2) Date: Apr. 12, 2017

(87) PCT Pub. No.: WO2016/058827
PCT Pub. Date: Apr. 21, 2016

(65) Prior Publication Data

US 2017/0229770 A1 Aug. 10, 2017

(30) Foreign Application Priority Data

Oct. 16, 2014 (WO) ..... PCT/CN2014/088737
Dec. 19, 2014 (EP) ..... 14199288

(51) Int. Cl.
*H01Q 1/46* (2006.01)
*H05B 37/02* (2006.01)
(Continued)

(52) U.S. Cl.
CPC ..... *H01Q 1/46* (2013.01); *H01Q 1/22* (2013.01); *H01Q 7/00* (2013.01); *H05B 37/0272* (2013.01); *H01R 9/2475* (2013.01)

(58) Field of Classification Search
CPC ..... H01Q 1/22; H01Q 1/46
(Continued)

(56) References Cited

U.S. PATENT DOCUMENTS 4,864,318 A 9/1989 Iwasaki et al.
7,417,592 B1 8/2008 Hsiao et al.
(Continued)

FOREIGN PATENT DOCUMENTS

CN 203482454 U 3/2014
EP 2372765 A1 10/2011
(Continued)

*Primary Examiner* — Peguy Jean Pierre

(57) ABSTRACT

The invention provides a connection head (40) for using with a supply cable for supplying power to a device, which device is within a housing. A first end (41) of the connection head is for mounting outside the housing of the device. A second end (43) of the connection head is for mounting inside the housing of the device. A closed loop antenna has at least one coil and a pair of feed lines, wherein the feed lines extend from the first end (41) to the second end (43), and the at least one coil is located within the first end (41). The connection head of the supply cable provides protection for an antenna and enables the antenna to be mounted outside the housing.

15 Claims, 3 Drawing Sheets

(51) Int. Cl.
*H01Q 7/00* (2006.01)
*H01Q 1/22* (2006.01)
*H01R 9/24* (2006.01)

(58) Field of Classification Search
USPC ..... 343/702
See application file for complete search history.

(56) References Cited

U.S. PATENT DOCUMENTS

| | | | | |
|---|---|---|---|---|
| 2005/0215119 | A1 | 9/2005 | Kaneko | |
| 2015/0048209 | A1* | 2/2015 | Hoyt | B33Y 80/00 244/131 |
| 2015/0175052 | A1* | 6/2015 | Gergets | B60Q 1/2611 362/542 |
| 2016/0084479 | A1* | 3/2016 | Togawa | G01N 21/8806 362/382 |

FOREIGN PATENT DOCUMENTS

| | | | |
|---|---|---|---|
| EP | 2629363 | A1 | 8/2013 |
| JP | 027245 | A | 1/1990 |
| WO | 2005101919 | A1 | 10/2005 |
| WO | 2011072714 | A1 | 6/2011 |
| WO | 2013153522 | A1 | 10/2013 |

* cited by examiner

SUPPLY CABLE, A DRIVER ARRANGEMENT WITH WIRELESS CONTROL FUNCTION AND A CONTROL METHOD

CROSS-REFERENCE TO PRIOR APPLICATIONS

This application is the U.S. National Phase application under 35 U.S.C. § 371 of International Application No. PCT/EP2015/072498, filed on Sep. 30, 2015 which claims the benefit of Chinese Patent Application No. PCT/CN2014/088737, filed on Oct. 16, 2014 and European Patent Application No. 14199288.3, filed Dec. 19, 2014. These applications are hereby incorporated by reference herein.

FIELD OF THE INVENTION

This invention relates to devices which incorporate an antenna for receiving and/or transmitting wireless commands. It relates in particular to applications where the device has a housing which needs to be enclosed, for example weatherproof, and where such housing would block the antenna signal.

BACKGROUND OF THE INVENTION

One application of interest is wirelessly configurable LED drivers.

With the rapid adoption of LED technology, there is a growing need for programmable electronic drivers that may be configured on demand to suit end application requirements. This helps luminaire manufacturers manage inventory better, by reducing the number of stock keeping units. As an example, an LED driver may be designed to support a range of current levels and dimming options such as 0-10V, DALI etc.

A luminaire manufacturer can then program the LED driver to a specific current level late in the manufacturing process. Such programmable LED drivers are commercially available and are usually configured using wired communication interfaces like RS-232 or DALI. Wireless solutions like Wifi or Zigbee also exist but are limited due to high cost.

In order to provide the wireless communication function, a dedicated antenna is required for the wireless communication system. For high ingress protection ("IP") applications, such as IP65 and higher, the antenna has to satisfy the IP rating as well as the LED driver enclosure. This can present difficulties, particularly as it is desirable to place the antenna outside the protective enclosure of the LED driver.

The same issues apply to other applications in which a device is mounted inside an enclosure and includes a wireless receiver (and/or transmitter) circuit, which requires an associated antenna, and the antenna needs to be outside the enclosure.

There is thus a general need for an antenna arrangement for such applications.

It is known to integrate a radio antenna into a cable, for example an earphone cable for use with mobile phones, as disclosed in U.S. Pat. No. 7,417,592. The aim is to find a space for a long UHF and VHF antenna.

EP2629363A1 discloses an antenna integrated harness of electric cables.

SUMMARY OF THE INVENTION

It would be advantageous to have a solution/structure that enables an integration of the antenna with the housing in a way that the antenna is not influenced/blocked by the housing. It would be also advantageous to keep the ingress protection of the housing even if an antenna is integrated.

To address at least the above issue, the invention is defined by the claims.

According to an aspect of the invention, there is provided a connection head for using with a supply cable to a device which is within a housing, comprising:

a first end for mounting outside the housing of the device;

a second end for mounting inside the housing of the device; and a closed loop antenna having at least one coil and a pair of feed lines, wherein the feed lines extend from the first end to the second end, and the at least one coil is located the first end.

This arrangement makes use of a connection head for cable to provide protection for an antenna. In this way, the number of protected openings to the housing is kept to a minimum. For example, the connection head which is used to route the supply cables to the interior of the housing will already meet the desired sealing requirements (e.g. IP65). As a result, the same sealing requirements are met by the antenna arrangement without requiring additional protective sheaths or openings in the housing. The connection head can be applied to any device having an outer housing, when it is desired to mount an antenna outside the housing. Also, the antenna is not blocked by the housing thus the wireless communication performance is maintained.

The at least one coil may be oriented around an elongate axis of the connection head, and the supply cable may further comprise power lines, different from said closed loop antenna, for transferring power.

This provides a compact arrangement of both power lines and the antenna, which can also be assembled easily.

The antenna may for example comprise between 6 and 10 coils each with a diameter of 8 to 12 mm. One particular example can make use of 8 coils of diameter 10 mm. By way of example, the antenna is designed for an RF frequency of 13.56 MHz. This is one example of frequency used in a Near Field Communications (NFC) protocol. The coils may for example have an inductance of 4.3 μH.

Further, the connection head is made of radio non-blocking material. Thus the antenna will not be blocked by the connection head and wireless communication performance can be maintained.

For easy and secure engagement between the connection head and the housing, the connection head includes an annular recess for engaging with an opening in the housing, wherein the at least one coil of the antenna is encapsulated within the first end of the connection head at an exterior side of the annular recess, and said second end (for mounting inside the housing) is at an interior side of the annular recess. This embodiment provides a fixing structure to fix the connection head to the housing, and such fixing structure is also applicable to encapsulate and protect the antenna.

The enlarged connection head can be a rubber material so that there is a watertight seal between the recess and the opening in the housing. By fitting the antenna coil or coils in the enlarged head, a good use of space is made, and the antenna is at a close proximity to the receiver inside the housing. There may for example be a distance of 20 to 30 mm between the receiver and the antenna.

The device may be a receiver circuit for receiving wireless control signals via the closed loop antenna, and the closed loop antenna may be a near field communications ("NFC") antenna which is further adapted to provide power to the receiver circuit. This means the NFC communication can be used to control or configure the device, and this may also provide the required power for the configuration without the need for the supply power lines to be active. In this way, the configuration can be carried out as a final stage in the production process, before the device is mains powered.

In one embodiment, the connection head is for enclosing an outer sheath of the supply cable. Alternatively, the connection head is integral with an outer sheath of the supply cable. These two embodiments provide alternative structures of the connection head, either separate from the supply cable as independent components, or integral with the supply cable as a single component.

An example of the invention also provides a driver arrangement for driving a lighting arrangement, comprising:

a housing;

a connection head as defined above;

a supply cable for supplying power, passing from outside the housing to inside the housing through the connection head (40);

a receiver circuit within the housing, coupled to the antenna via the pair of feed lines for receiving wireless control signals; and a driver circuit within the housing, for obtaining power from the supply cable and driving the lighting arrangement using the obtained power, wherein the driver circuit is coupled to said receiver circuit and configurable based on the wireless control signals received by the antenna and forwarded by the receiver circuit.

This arrangement makes use of the cable connection head to a driver arrangement to provide protection for an antenna. The connection head for example allowing the power lines pass through for supplying power to the lighting arrangement using the driver arrangement.

The connection head is adapted to provide a watertight passage of the supply cable into the housing. This single watertight passage allows the antenna and the supply cables to pass through the housing opening.

A powering cable may also be provided for connection between the driver arrangement and the lighting arrangement for transferring power to the lighting arrangement, which powering cable also has a watertight passage through the housing. The housing is then for a driver arrangement, with an inlet passageway for a supply cable and an outlet passageway for a drive cable which leads to the lighting arrangement.

The driver arrangement may for example satisfy the IP65 requirements.

In one example, the antenna comprises an NFC antenna and the receiver circuit comprises an NFC integrated circuit, wherein the NFC integrated circuit is adapted to be powered by the NFC antenna, and the receiver circuit is adapted to be disabled when the driver circuit starts to drive the lighting arrangement. In this way, the wireless functionality is used only as part of the production process/re-configuration process and does not play a role in the normal user operation of the device. However, the wireless functionality may instead contribute to the user functionality of the device.

The NFC communication is for example used to send control or configuration commands to the driver from a remote control device. These can be used before the driver arrangement is used by the end-user, and can be part of a final stage of production. The configuration does not need the device to be powered because the configuration can be implemented using power transfer over the antenna.

The driver circuit may be configurable for example to set a current output level and/or set a current dimming level according to the wireless control signals.

The receiver circuit may further be adapted as a transceiver also for transmitting wireless control signals. The driver circuit is then further configurable to transmit wireless control signals via the transceiver circuit and the closed loop antenna.

This enables two way communication between the driver circuit and the external controller.

Examples in accordance with another aspect provide a lighting system comprising:

the driver arrangement as defined above; and a lighting arrangement driven by the driver arrangement.

Examples in accordance with another aspect provide a method of controlling a device which is housed within a housing, comprising:

providing wireless control signals;

receiving the wireless control signals using an antenna which is mounted outside the housing of the device and a receiver circuit mounted inside the housing of the device; and controlling or configuring the device based on the wireless control signals, wherein the antenna comprises a closed loop antenna having at least one coil and a pair of feed lines, wherein the feed lines extend from within the housing to outside the housing and within the outer sheath of a supply cable to the device, and wherein the at least one coil is located outside the housing within a connection head for using with a supply cable for supplying power to the device.

This method applies generally to controlling a device in a housing, where it is desired to mount an antenna outside the housing. The antenna is mounted in a supply cable sheath.

The device may comprise a receiver circuit for receiving wireless control signals via the closed loop antenna, and the closed loop antenna is a near field communications antenna which is further adapted to provide power to the receiver circuit. The device then for example further comprises a driver arrangement for driving a lighting arrangement, the controlling of the device comprises configuring the driver arrangement based on the wireless control signals.

The configured driver arrangement can then be used to drive the lighting arrangement using the configured driver arrangement.

The method can thus be applied to a driver arrangement for lighting. Configuring the driver arrangement may comprise setting a current output level and/or setting a current dimming capability.

The above and other unmentioned effect and advantageous will be learned by those skilled in the art by studying the below detailed embodiments of the invention with reference to the drawings.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a supply cable for supplying power to a device, which device is within a housing. A first portion is for mounting outside the housing of the device, the first portion having an outer sheath. A second portion is for mounting inside the housing of the device. A closed loop antenna has at least one coil and a pair of feed lines, wherein the feed lines extend from within the outer sheath of the first portion to the second portion, and the at least one coil is located within the outer sheath of the first portion. The outer sheath of the supply cable provides protection for an antenna and enables the antenna to be mounted outside the housing.

Figure 1:
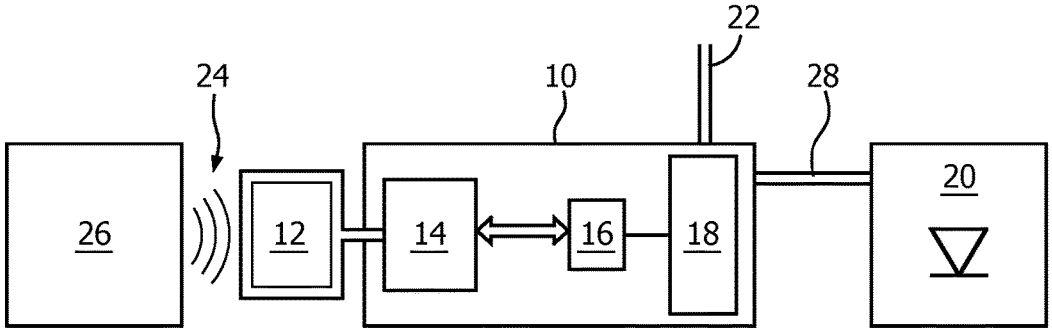
FIG. 1 shows a lighting arrangement.

FIG. 1 shows a lighting arrangement which can be modified to use an antenna configuration in accordance with an example of the invention. The lighting arrangement uses near field communication (NFC) protocols for communication with the LED driver, in particular for setting driver configurations late in the manufacture of the driver, or re-configuring the driver after it has be used/deployed by the user.

The LED driver has an outer housing 10 inside which the main circuit elements are housed. An NFC antenna 12 is external to the housing 10 and it connects to an NFC integrated circuit (which may be a receiver circuit or a transceiver circuit) and memory. The integrated circuit and memory are shown together as unit 14. There is data and power transfer to a microcontroller 16 which controls a power output stage 18. The power output stage 18 and the microcontroller 16 together function as a driver circuit. The driver circuit controls an output load 20 in the form of an LED arrangement.

The driver circuit receives power from an input mains cable 22.

The configuration of the driver circuit can be established using the NFC interface 24 with a host device 26 which may comprise a mobile telephone or other computer device. An output cable 28 transfers power from the driver circuit to the LED arrangement 20.

The NFC interface can be for the transfer of data and also power, for example using an ISO/IEC 16593 protocol, at a frequency of 13.56 MHz. Of course, other wireless transmission protocols and frequencies may be used.

This means the LED driver can be configured without mains power being active. When the driver is eventually powered, the configuration information can be retrieved from the memory, for example for retrieving current setting levels or dimming options. The driver is then configured, and the NFC interface may be disabled so that it does not play any role in the normal use of the LED driver.

FIG. 1 shows the antenna 12 outside the main housing 10, and this has benefits for reducing electromagnetic shielding.

These embodiments of the invention are of particular interest when the housing 10 requires a level of ingress protection, so that it can be used outdoors. In this case, each connection between an external component and an internal component requires a suitable connector for passage through the housing wall.

This embodiment of the invention in particular makes use of a single opening in the housing for the antenna feed lines and for the power supply cable 22.

Figure 2:
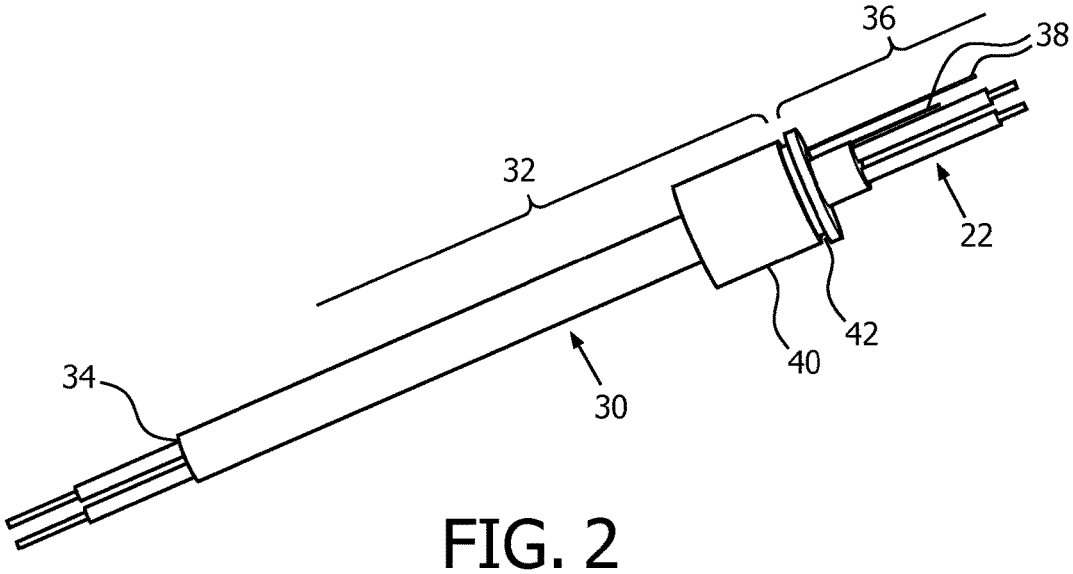
FIG. 2 shows a supply cable for supplying power to the inside of a housing and incorporating an antenna.

FIG. 2 shows a supply cable for this purpose, for supplying power to the inside of the housing 10.

The cable 30 has a first portion 32 for mounting outside the housing 10, the first portion having an outer sheath 34. A second portion 36 is for mounting inside the housing 10. A closed loop antenna has at least one coil and a pair of feed lines 38. The feed lines extend from within the outer sheath of the first portion 32 to the second portion 36 (i.e. they pass from outside to inside the housing), and the at least one coil is located within the outer sheath of the first portion 32.

This arrangement makes use of the outer sheath 34 to provide protection for the antenna. The routing of the cable through the housing opening will for example meet a desired sealing requirement such as IP65. As a result, the same sealing requirements are met by the antenna arrangement without requiring additional protective sheaths or openings in the housing.

The supply cable has an enlarged connection head 40 including an annular recess 42 for engaging with an opening in the housing 10. This connection head can be considered to enclose the outer sheath 34 of the cable, so that components defined as "within the outer sheath" include components within the enlarged connection head 40. The at least one coil of the antenna is encapsulated within a first end of the enlarged connection head at the exterior side of the annular recess 42. Then second portion 36 of the cable includes a second end of the enlarged connection head 40 at the internal side of the annular recess 42.

Figure 3:
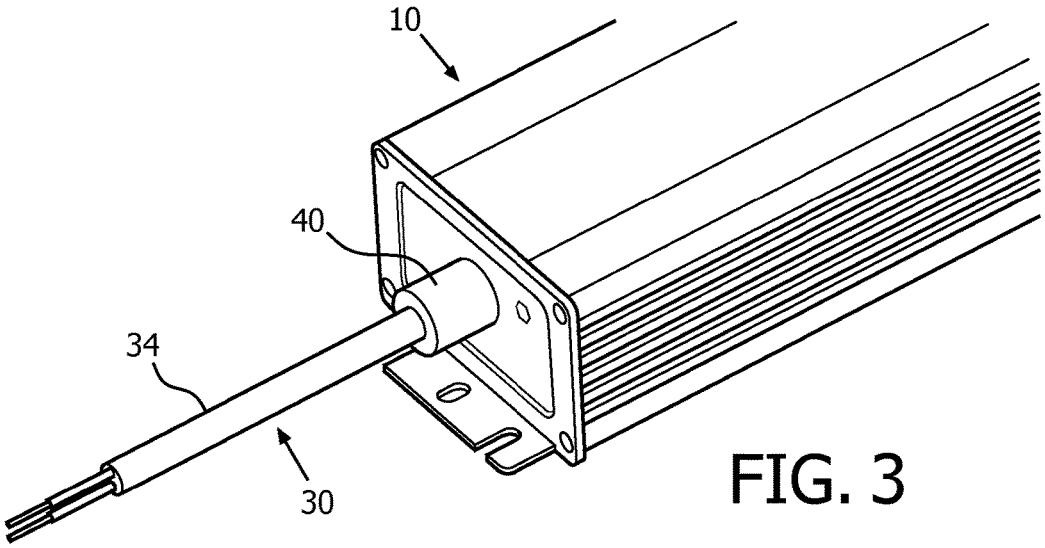
FIG. 3 shows the supply cable passing through an opening in the housing.

FIG. 3 shows the supply cable passing through an opening in the housing 10. The housing is for example a metal box for mounting on a surface outdoors.

Figure 4:
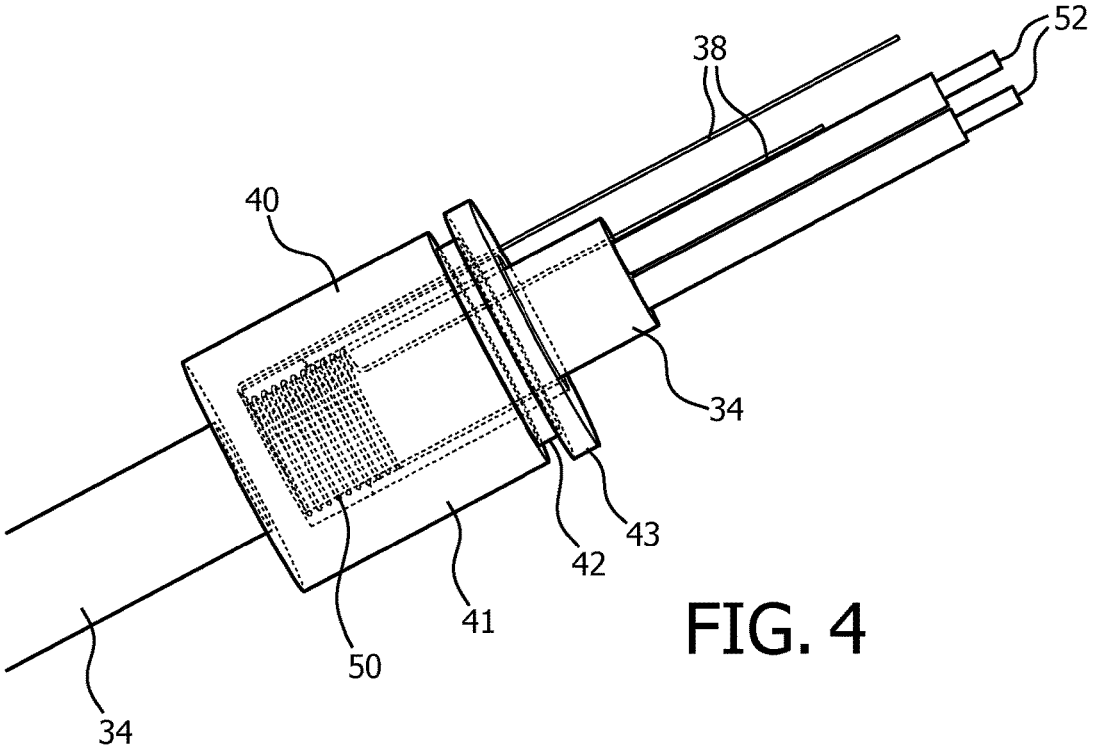
FIG. 4 shows the supply cable in transparent view to show the antenna coils.

FIG. 4 shows the supply cable in transparent view to show the antenna coils 50. The antenna 12 has a series of coils 50 oriented around an elongate axis of the supply cable 30, and the supply cable comprises power lines 52, different from the closed loop antenna, for transferring power. The enlarged head has a first part 41 on the external side of the recess 42 and a second part 43 on the internal side of the recess 42.

Figure 5:
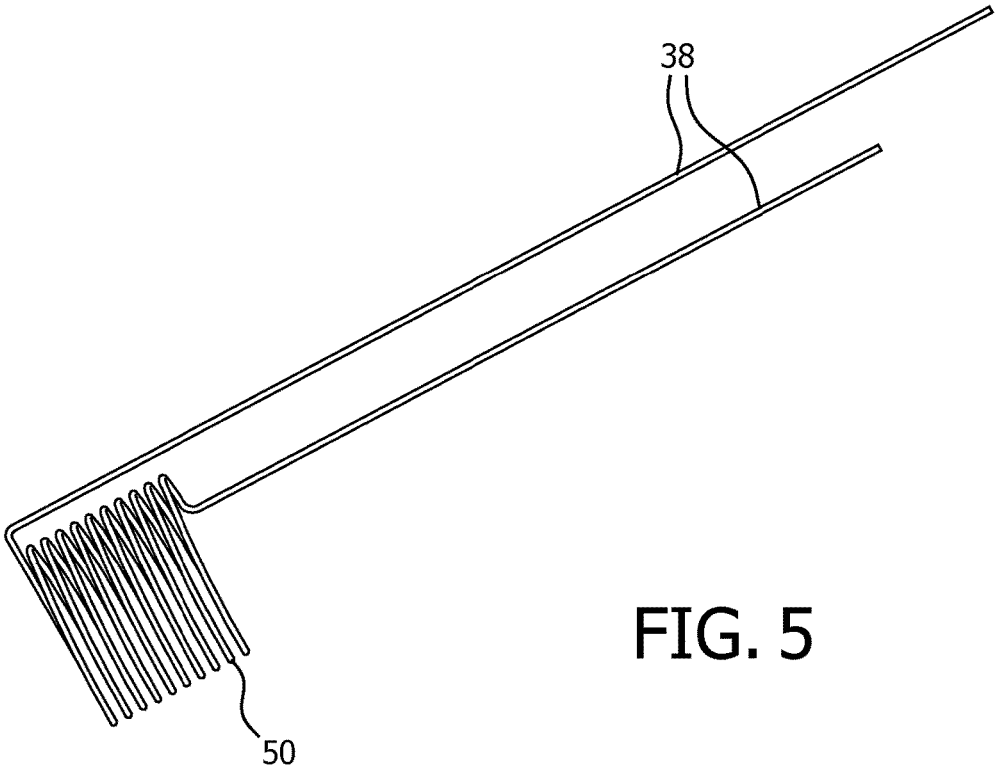
FIG. 5 shows the antenna arrangement more clearly.

FIG. 5 shows the antenna arrangement more clearly.

The antenna may for example comprise between 6 and 10 coils (10 are shown in FIG. 5) each with a diameter of 8 to 12 mm. One particular example can make use of 8 coils of diameter 10 mm. By way of example, the antenna is designed for an RF frequency of 13.56 MHz. The coils may for example have an inductance of 4.30 μH.

The enlarged connection head 40 is a rubber material which provides a watertight seal between the recess 42 and the opening in the housing. By fitting the antenna coil or coils in the enlarged head, a good use of space is made, and the antenna is at a close proximity to the receiver inside the housing. There may for example be a distance of 20 to 30 mm between the receiver and the antenna.

Figure 6:
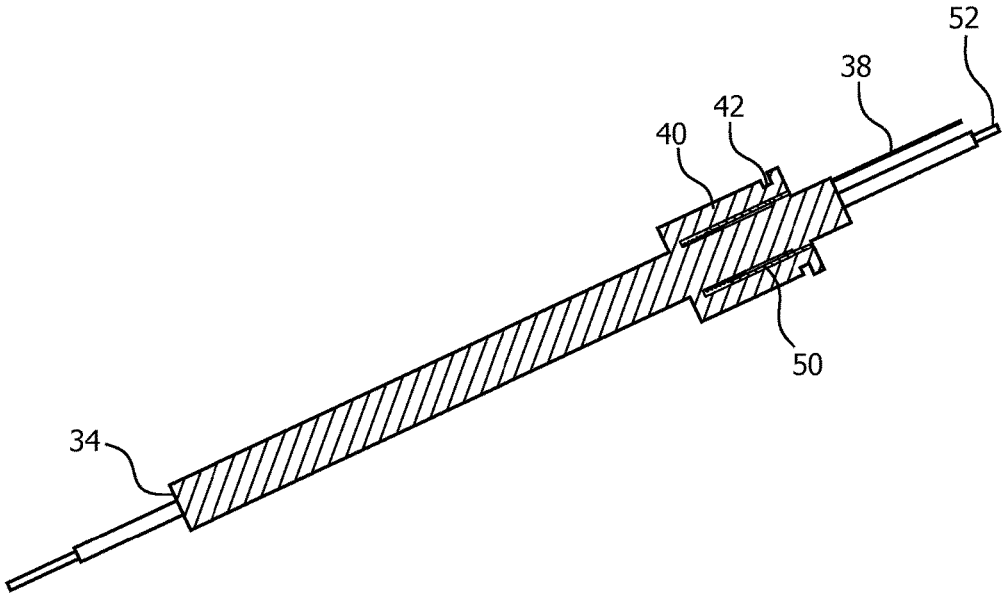
FIG. 6 shows the cable in cross section.

FIG. 6 shows the cable in cross section, showing one power supply cable 52 and one antenna feed 38 behind the plane of the cross section. The outer sheath 34 can be integral with the enlarged head 40 and they can be formed as a single molded component, molded around the supply cables 52 and the antenna. In this case, the material of the enlarged head is the same as the material of the cable sheath, but they may instead be different materials.

The cable can be used to replace the separate external connections to the antenna and to the power supply which are shown in FIG. 1, but all other features of the lighting system of FIG. 1 can be adopted.

Thus, a driver arrangement is provided for driving a lighting arrangement, comprising the housing 10, the supply cable 30 passing from outside the housing to inside the housing and the receiver circuit 14 within the housing, coupled to the antenna via the pair of feed lines 38. The driver circuit 16, 18 is also within the housing 10, for obtaining power from the supply cable 22 and driving the lighting arrangement 20 using the obtained power. The separate powering cable 28 connects between the driver arrangement and the lighting arrangement 20 for transferring power to the lighting arrangement. This has another watertight passage through the housing.

The receiver circuit 14 may further be adapted as a transceiver also for transmitting wireless control signals. The driver circuit 16,18 is then further configurable to transmit wireless control signals via the transceiver circuit and the closed loop antenna.

This enables two-way communication between the driver circuit and the external controller.

As mentioned above, the antenna can provide power for the configuration function. The NFC integrated circuit and the memory can be passively powered components over the wireless NFC link, with the host device 26 functioning as the source of power.

The invention is not limited to lighting systems. A similar NFC control or configuration can be applied to various applications, including wireless payment terminals used in transport networks, E-wallets and other portable electronic devices.

In the specific example above, the NFC communications link is only used for configuration. However, in other applications, the NFC wireless communication may also be used as part of the normal functioning of the device, so that a user can interface with a device in the housing using the NFC link.

The invention is also not limited to any particular NFC protocol. Indeed any wireless communication standard can be used providing a suitable antenna can be designed based on the range of possible dimensions of coils a supply cable.

As mentioned above, it is known to integrate a radio antenna into an earphone cable for use with mobile phones, for example as disclosed in U.S. Pat. No. 7,417,592. There are significant differences between embodiments of the invention with this known integrated radio antenna.

First, in embodiments of the invention, the supply cable is for supplying power into the housing. For the earphone case, the earphone cable is for transferring the audio signal.

By putting the antenna in the supply cable, radio blocking from the metal enclosure of the driver housing is avoided, while also maintaining the high ingress protection capacity of the enclosure of the driver housing. For the earphone case, the problem to be addressed is that there is not enough space for a UHF radio antenna and a VHF radio antenna which are normally very long. The enclosure of a smartphone normally does not block radio signals (otherwise the cell antenna will also be blocked), so the problem of shielding by a housing does not arise.

Additionally, for the current smartphones which include NFC capability, such as the iPhone (Trade Mark) series, it is customary to put the NFC antenna also in the phone housing, such as underneath the back plate, not outside the housing.

There is also a consequent difference for the peripheral circuit. In embodiments of the invention, the NFC circuit does not need the driver to be powered on, because the NFC antenna, the associated NFC integrated circuit and the memory are not powered by the driver but they are powered by the external host NFC transceiver. In the earphone case, the reception and detection circuits for VHF and UHF radio in the smartphone need to be turned on by the phone to receive radio signals from the antenna. The circuitry used in the earphone case thus cannot be used in the embodiments above without adaptation.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A driver arrangement for driving a lighting arrangement, comprising:

a housing (10);

a connection head, comprising:

a first end for mounting outside the housing of the device;

a second end for mounting inside the housing of the device; and a closed loop antenna having at least one coil and a pair of feed lines, wherein the feed lines extend from the first end to the second end, and the at least one coil is located within the first end;

a supply cable for supplying power, passing from outside the housing to inside the housing through the connection head;

a receiver circuit within the housing, coupled to the antenna via the pair of feed lines for receiving wireless control signals; and a driver circuit within the housing, for obtaining power from the supply cable and driving the lighting arrangement using the obtained power, wherein the driver circuit is coupled to said receiver circuit and configurable based on the wireless control signals received by the antenna and forwarded by the receiver circuit.

2. A driver arrangement as claimed in claim 1, wherein the connection head comprises a watertight passage for the supply cable into the housing.

3. A driver arrangement as claimed in claim 2, further comprising a powering cable for connection between the driver arrangement and the lighting arrangement for transferring power to the lighting arrangement, which powering cable also has a watertight passage through the housing.

4. A driver arrangement as claimed in claim 3 which satisfies the IP65 requirements.

5. A driver arrangement as claimed in claim 1, wherein the antenna comprise an NFC antenna and the receiver circuit comprises an NFC integrated circuit, wherein the NFC integrated circuit is adapted to be powered by the NFC antenna, and the receiver circuit is adapted to be disabled when the driver circuit starts to drive the lighting arrangement.

6. A driver arrangement as claimed in claim 1, wherein the driver circuit is configurable to set a current output level and/or set a current dimming level according to the wireless control signals, and the receiver circuit is further adapted as a transceiver also for transmitting wireless control signal, and the driver circuit is further configurable to transmit wireless control signals via the transceiver circuit and the closed loop antenna.

7. A lighting system comprising:

a driver arrangement as claimed in claim 1; and a lighting arrangement driven by the driver arrangement.

8. A driver arrangement as claimed in claim 1, wherein the connection head further comprising:

an annular recess for engaging with an opening in the housing, wherein the at least one coil of the antenna is encapsulated within the first end of the connection head at an exterior side of the annular recess, and said second end of the connection head is at an interior side of the annular recess, and wherein said antenna is adapted to communicate with a host device separate from and external to the supply cable and the housing, and the supply cable is a single and undetachable cable and the connection head is for allowing the cable passing through and into the housing.

9. A driver arrangement as claimed in claim 1, wherein the at least one coil is oriented around an elongate axis of the connection head, and the connection head further allowing passing through of power lines, different from said closed loop antenna, for transferring power.

10. A driver arrangement as claimed in claim 1, wherein the antenna comprises between 6 and 10 coils each with a diameter of 8 to 12 mm, and wherein the connection head is made of radio non-blocking material.

11. A driver arrangement as claimed in claim 1, wherein the closed loop antenna is a near field communications antenna which is further adapted to provide power to a receiver circuit of the device.

12. A driver arrangement as claimed in claim 1, wherein the connection head is for enclosing an outer sheath of the supply cable or, the connection head is integral with an outer sheath of the supply cable.

13. A method of controlling a device which is housed within a housing, comprising:

providing wireless control signals;

receiving the wireless control signals using an antenna which is mounted outside the housing of the device and a receiver circuit 444 mounted inside the housing of the device; and controlling or configuring the device based on the wireless control signals, wherein the antenna comprises a closed loop antenna having at least one coil and a pair of feed lines, wherein the feed lines extend from within the housing to outside the housing, and wherein the at least one coil is located outside the housing within a connection head for using with a supply cable for supplying power to the device;

wherein the device comprises a receiver circuit for receiving wireless control signals via the closed loop antenna, and the closed loop antenna is a near field communications antenna which is further adapted to provide power to the receiver circuit;

the device further comprises a driver arrangement for driving a lighting arrangement;

controlling the device comprises configuring the driver arrangement based on the wireless control signals.

14. A connection head for using with a supply cable to a device which is within a housing, comprising:

a first end for mounting outside the housing of the device;

a second end for mounting inside the housing of the device;

a closed loop antenna having at least one coil and a pair of feed lines, wherein the feed lines extend from the first end to the second end, and the at least one coil is located within the first end;

wherein said antenna is adapted to communicate with a host device separate from and external to the supply cable and the housing.

15. A connection head according to claim 14, wherein an annular recess for engaging with an opening in the housing, wherein the at least one coil of the antenna is encapsulated within the first end of the connection head at an exterior side of the annular recess, and said second end of the connection head is at an interior side of the annular recess, and the connection head for allowing the supply cable passing through and into the housing.

* * * * *